US008637109B2

(12) United States Patent
Grewe et al.

(10) Patent No.: US 8,637,109 B2
(45) Date of Patent: Jan. 28, 2014

(54) MANUFACTURING METHODS FOR COVERING ENDOLUMINAL PROSTHESES

(75) Inventors: David Grewe, West Lafayette, IN (US); Blayne Roeder, Lafayette, IN (US); Steven Charlebois, West Lafayette, IN (US); Adam Griebel, Hoagland, IN (US)

(73) Assignee: Cook Medical Technologies LLC, Bloomington, IN (US)

( * ) Notice: Subject to any disclaimer, the term of this patent is extended or adjusted under 35 U.S.C. 154(b) by 163 days.

(21) Appl. No.: 12/959,023

(22) Filed: Dec. 2, 2010

(65) Prior Publication Data

US 2011/0135806 A1 Jun. 9, 2011

Related U.S. Application Data

(60) Provisional application No. 61/266,281, filed on Dec. 3, 2009.

(51) Int. Cl.
*B05D 1/32* (2006.01)
*B05D 1/16* (2006.01)

(52) U.S. Cl.
USPC ..... 427/2.1; 427/2.24; 427/2.25; 427/256; 427/282; 427/458; 427/462; 425/72.2

(58) Field of Classification Search
USPC ..... 427/2.1, 2.24, 2.25, 282, 259, 462, 468, 427/458, 256; 425/72.2
See application file for complete search history.

(56) References Cited

U.S. PATENT DOCUMENTS

| | | | | |
|---|---|---|---|---|
| 3,280,229 | A | 10/1966 | Simons | |
| 4,130,904 | A | 12/1978 | Whalen | |
| 4,323,525 | A | 4/1982 | Bornat | |
| 4,434,797 | A | 3/1984 | Silander | 128/343 |
| 4,629,458 | A | 12/1986 | Pinchuk | |
| 4,657,544 | A | 4/1987 | Pinchuk | 623/1 |
| 4,689,186 | A * | 8/1987 | Bornat | 264/6 |
| 4,759,757 | A | 7/1988 | Pinchuk | |

(Continued)

FOREIGN PATENT DOCUMENTS

| | | |
|---|---|---|
| JP | 2004-313320 | 11/2004 |
| JP | 2006-283241 A | 10/2006 |

(Continued)

OTHER PUBLICATIONS

Salim et al. Selective nanofiber deposition via electrodynamic focusing. Nanotechnology. vol. 19. (2008).*

(Continued)

*Primary Examiner* — Cachet Sellman
(74) *Attorney, Agent, or Firm* — Brinks Hofer Gilson & Lione

(57) ABSTRACT

The disclosure relates to a method for coating a target. The method includes providing a target and an electrospinning apparatus. The target comprises a first surface and an opposing second surface. The electrospinning apparatus comprises a mandrel, a mask including an aperture, a reservoir loaded with a solution, and an orifice fluidly coupled to the reservoir. The mandrel is located adjacent the target second surface. The orifice is located at a distance from the target first surface. The mask is located intermediate the orifice and the target first surface. The solution is electrospun through the mask aperture onto the target first surface. In one example the target is an endoluminal prosthesis.

15 Claims, 5 Drawing Sheets

(56) References Cited

U.S. PATENT DOCUMENTS

| | | | | |
|---|---|---|---|---|
| 4,776,337 | A | 10/1988 | Palmaz | 128/343 |
| 5,078,736 | A | 1/1992 | Behl | 623/1 |
| 5,628,788 | A | 5/1997 | Pinchuk | |
| 5,716,395 | A | 2/1998 | Myers et al. | |
| 5,728,150 | A | 3/1998 | McDonald et al. | 623/1 |
| 5,769,884 | A * | 6/1998 | Solovay | 623/1.13 |
| 5,866,217 | A | 2/1999 | Stenoien et al. | |
| 6,007,573 | A | 12/1999 | Wallace et al. | 623/1 |
| 6,110,198 | A | 8/2000 | Fogarty et al. | 623/1.12 |
| 6,306,424 | B1 | 10/2001 | Vyakarnam et al. | 424/426 |
| 6,334,868 | B1 | 1/2002 | Ham | 623/1.13 |
| 6,398,803 | B1 | 6/2002 | Layne et al. | |
| 6,537,310 | B1 | 3/2003 | Palmaz et al. | 623/1.13 |
| 6,558,414 | B2 | 5/2003 | Layne | |
| 6,579,314 | B1 | 6/2003 | Lombardi et al. | |
| 6,616,435 | B2 | 9/2003 | Lee et al. | 425/83.1 |
| 6,638,621 | B2 | 10/2003 | Anderson | 428/402.24 |
| 6,685,956 | B2 | 2/2004 | Chu et al. | 424/423 |
| 6,753,311 | B2 | 6/2004 | Fertala et al. | 514/2 |
| 6,790,455 | B2 | 9/2004 | Chu et al. | 424/423 |
| 6,821,479 | B1 | 11/2004 | Smith et al. | 422/1 |
| 6,858,168 | B1 | 2/2005 | Vollrath et al. | 264/41 |
| 6,865,810 | B2 | 3/2005 | Stinson | 29/896.6 |
| 6,936,298 | B2 | 8/2005 | Chaikof et al. | 427/2.24 |
| 6,989,195 | B2 | 1/2006 | Anderson | 428/402.24 |
| 7,070,836 | B2 | 7/2006 | Czado | 427/462 |
| 7,081,622 | B2 | 7/2006 | Kameoka et al. | 250/288 |
| 7,105,229 | B2 | 9/2006 | Anderson | 428/402.2 |
| 7,105,810 | B2 | 9/2006 | Kameoka et al. | 250/288 |
| 7,112,417 | B2 | 9/2006 | Vyakarnam et al. | 435/41 |
| 7,134,857 | B2 | 11/2006 | Andrady et al. | 425/66 |
| 7,143,963 | B2 | 12/2006 | Tani et al. | 239/456 |
| 7,172,765 | B2 | 2/2007 | Chu et al. | 424/423 |
| 7,244,272 | B2 | 7/2007 | Dubson et al. | |
| 7,247,338 | B2 | 7/2007 | Pui et al. | |
| 7,306,756 | B2 | 12/2007 | Edwin et al. | |
| 7,390,524 | B1 | 6/2008 | Chen | |
| 7,413,575 | B2 | 8/2008 | Phaneuf et al. | |
| 7,591,841 | B2 | 9/2009 | Hossainy et al. | |
| 7,704,274 | B2 | 4/2010 | Boyle et al. | 623/1.13 |
| 7,736,687 | B2 | 6/2010 | Sims et al. | 427/2.1 |
| 7,794,833 | B2 | 9/2010 | Balkus, Jr. et al. | 428/364 |
| 7,799,261 | B2 | 9/2010 | Orr et al. | 264/441 |
| 7,815,763 | B2 * | 10/2010 | Fierens et al. | 156/167 |
| 7,824,601 | B1 * | 11/2010 | Stankus et al. | 264/465 |
| 7,854,760 | B2 | 12/2010 | Molaei et al. | 623/1.38 |
| 7,922,761 | B2 | 4/2011 | Shalev et al. | |
| 7,947,069 | B2 | 5/2011 | Sanders | |
| 8,057,535 | B2 | 11/2011 | Hashi et al. | |
| 8,100,683 | B2 | 1/2012 | Orr et al. | 425/174.8 R |
| 8,123,794 | B2 | 2/2012 | Flagle et al. | |
| 8,157,857 | B2 | 4/2012 | Case et al. | |
| 8,178,030 | B2 | 5/2012 | Anneaux et al. | |
| 8,257,640 | B2 | 9/2012 | Anneaux et al. | |
| 8,262,979 | B2 | 9/2012 | Anneaux et al. | |
| 2003/0100944 | A1 | 5/2003 | Laksin et al. | 623/1.44 |
| 2003/0109917 | A1 | 6/2003 | Rudin et al. | |
| 2003/0195611 | A1 | 10/2003 | Greenhalgh et al. | |
| 2003/0211135 | A1 | 11/2003 | Greenhalgh et al. | |
| 2004/0018226 | A1 | 1/2004 | Wnek et al. | 424/443 |
| 2004/0030377 | A1 | 2/2004 | Dubson et al. | |
| 2004/0037813 | A1 * | 2/2004 | Simpson et al. | 424/93.7 |
| 2004/0051201 | A1 | 3/2004 | Greenhalgh et al. | |
| 2004/0116997 | A1 | 6/2004 | Taylor et al. | 623/1.11 |
| 2004/0241436 | A1 | 12/2004 | Hsieh et al. | 428/361 |
| 2005/0064168 | A1 | 3/2005 | Dvorsky et al. | 428/292.1 |
| 2005/0104258 | A1 * | 5/2005 | Lennhoff | 264/465 |
| 2005/0137680 | A1 | 6/2005 | Ortiz et al. | |
| 2006/0048355 | A1 | 3/2006 | Kim | 28/104 |
| 2006/0085063 | A1 | 4/2006 | Shastri et al. | 623/1.41 |
| 2006/0195142 | A1 * | 8/2006 | Shalaby | 606/228 |
| 2006/0200232 | A1 | 9/2006 | Phaneuf et al. | 623/1.42 |
| 2006/0213829 | A1 | 9/2006 | Rutledge et al. | 210/503 |
| 2006/0259131 | A1 * | 11/2006 | Molaei et al. | 623/1.44 |
| 2006/0264140 | A1 | 11/2006 | Andrady et al. | |
| 2007/0031607 | A1 | 2/2007 | Dubson et al. | 427/458 |
| 2007/0043428 | A1 | 2/2007 | Jennings et al. | 623/1.15 |
| 2007/0087027 | A1 | 4/2007 | Greenhalgh et al. | 424/423 |
| 2007/0162110 | A1 | 7/2007 | Dave | 623/1.42 |
| 2008/0027531 | A1 | 1/2008 | Reneker et al. | |
| 2008/0200975 | A1 | 8/2008 | Dubson | |
| 2008/0208325 | A1 | 8/2008 | Helmus et al. | |
| 2008/0241352 | A1 * | 10/2008 | Shalaby | 427/2.25 |
| 2009/0069904 | A1 | 3/2009 | Picha | 623/23.72 |
| 2009/0112306 | A1 | 4/2009 | Bonsignore et al. | |
| 2009/0138070 | A1 | 5/2009 | Holzer et al. | |
| 2009/0227026 | A1 | 9/2009 | Rapoport et al. | |
| 2009/0248131 | A1 | 10/2009 | Greenan | |
| 2010/0179644 | A1 | 7/2010 | Jennings et al. | |
| 2010/0222771 | A1 * | 9/2010 | Mitchell et al. | 606/1 |
| 2010/0241214 | A1 | 9/2010 | Holzer et al. | |
| 2010/0318193 | A1 * | 12/2010 | Desai et al. | 623/23.76 |
| 2011/0009949 | A1 | 1/2011 | Stankus et al. | |
| 2011/0022149 | A1 | 1/2011 | Cox et al. | |
| 2011/0022159 | A1 | 1/2011 | Fierens et al. | 623/1.39 |
| 2011/0262684 | A1 | 10/2011 | Wintsch et al. | |
| 2011/0301696 | A1 | 12/2011 | Mangiardi | |
| 2012/0141656 | A1 | 6/2012 | Orr et al. | |
| 2013/0018220 | A1 | 1/2013 | Vad et al. | |
| 2013/0122248 | A1 | 5/2013 | Haselby et al. | |

FOREIGN PATENT DOCUMENTS

| | | | |
|---|---|---|---|
| JP | 2007-303021 | | 11/2007 |
| WO | WO 03/072287 | A1 | 9/2003 |
| WO | WO 2010/112564 | A1 | 10/2010 |
| WO | WO 2012/006072 | A2 | 1/2012 |

OTHER PUBLICATIONS

Unpublished U.S. Appl. No. 13/295,589, filed Nov. 14, 2011 by Inventors Kenneth A. Haselby, et al.

* cited by examiner

MANUFACTURING METHODS FOR COVERING ENDOLUMINAL PROSTHESES

CROSS-REFERENCE TO RELATED APPLICATIONS

This application claims the benefit of priority to U.S. Provisional Application No. 61/266,281, filed Dec. 3, 2009, the disclosure of which is incorporated herein by reference in its entirety.

TECHNICAL FIELD

The present disclosure relates to manufacturing methods for endoluminal prostheses suitable for endovascular treatments and procedures, and, in particular, methods of covering an endoluminal prosthesis, such as a stent, using electrospinning.

BACKGROUND

Aneurysms occur in blood vessels in locations where, due to age, disease or genetic predisposition, the blood vessel strength or resiliency is insufficient to enable the blood vessel wall to retain its shape as blood flows therethrough, resulting in a ballooning or stretching of the blood vessel at the limited strength/resiliency location to thereby form an aneurysmal sac. If the aneurysm is left untreated, the blood vessel wall may continue to expand, to the point where the remaining strength of the blood vessel wall is below that necessary to prevent rupture, and the blood vessel will fail at the aneurysm location, often with fatal result.

To prevent rupture, a stent graft of a tubular construction may be introduced into the blood vessel, for example intraluminally. Typically, the stent graft is deployed and secured in a location within the blood vessel such that the stent graft spans the aneurysmal sac. The outer surface of the stent graft, at its opposed ends, is sealed to the interior wall of the blood vessel at a location where the blood vessel wall has not suffered a loss of strength or resiliency. Blood flow in the vessel is thus channeled through the hollow interior of the stent graft, thereby reducing, if not eliminating, any stress on the blood vessel wall at the aneurysmal sac location. Therefore, the risk of rupture of the blood vessel wall at the aneurysmal location is significantly reduced, if not eliminated, and blood can continue to flow through to the downstream blood vessels without interruption.

In many cases, however, the damaged or defected portion of the vasculature may include a branch vessel. For example, in the case of the abdominal aorta, there are at least three branch vessels, including the celiac, mesenteric, and renal arteries, leading to various other body organs. Thus, when the damaged portion of the vessel includes one or more of these branch vessels, some accommodation must be made to ensure that the stent graft does not block or hinder blood flow through the branch vessel.

A common method to provide continued blood flow to branch vessels includes by-pass vessels surgically located in an undamaged region of the aorta that is not stented. Such invasive methods, however, are undesirable. A less invasive technique to provide continued blood flow to branch vessels includes the placement of holes or fenestrations in the stent graft that are aligned with the side branch vessel so as to allow blood to continue to flow into the side branch vessel. This approach is the preferred method since it does not involve major vascular surgery.

SUMMARY

In one aspect, a method for coating a target is provided. The method includes providing a target and an electrospinning apparatus. The target comprises a first surface and an opposing second surface. The electrospinning apparatus comprises a mandrel, a mask including an aperture, a reservoir loaded with a solution, and an orifice fluidly coupled to the reservoir. The mandrel is located adjacent the target second surface. The orifice is located at a distance from the target first surface. The mask is located intermediate the orifice and the target first surface. The solution is electrospun through the mask aperture onto the target first surface.

In another aspect, a method for coating an endoluminal prosthesis is provided. The method includes providing an endoluminal prosthesis and an electrospinning apparatus. The endoluminal prosthesis defines an interior lumen with a proximal end, a distal end, a first surface and an opposing second surface. The electrospinning apparatus comprises a mandrel, a mask including an aperture, a reservoir loaded with a solution, an orifice fluidly coupled to the reservoir, and an energy source electrically coupled to the orifice and the mandrel. The energy source applies a first electrical potential to the orifice. The mandrel is grounded. The mandrel is located at least partially within the endoluminal prosthesis lumen. The orifice is located at a distance from the endoluminal prosthesis first surface. The mask is located intermediate the orifice and the endoluminal prosthesis first surface. The solution is electrospun through the mask aperture onto the endoluminal prosthesis first surface.

In a further aspect, a method for coating an endoluminal prosthesis is provided. The method includes providing an endoluminal prosthesis and an electrospinning apparatus. The endoluminal prosthesis defines an interior lumen with a proximal end, a distal end, a first surface and an opposing second surface. The electrospinning apparatus comprises a mandrel, a mask including an aperture, a reservoir loaded with a solution, an orifice fluidly coupled to the reservoir, a ground plane, and an energy source electrically coupled to the orifice, the mandrel and the mask. The mandrel is located at least partially within the endoluminal prosthesis lumen and adjacent the endoluminal prosthesis second surface. The orifice is located between about 5 inches to about 8 inches from the endoluminal prosthesis first surface. The mask is located intermediate the orifice and the endoluminal prosthesis first surface, and between about 2 inches to about 4 inches from the orifice. A first electrical potential between about 10 kV to about 30 kV is applied with the energy source to the orifice. A second electrical potential between about 5 kV to about 18 kV is applied with the energy source to the mask. The mandrel and ground plane are grounded. The orifice is moved relative to the endoluminal prosthesis. The solution is electrospun through the mask aperture onto the endoluminal prosthesis first surface.

Other systems, methods, features and advantages will be, or will become, apparent to one with skill in the art upon examination of the following figures and detailed description. It is intended that all such additional systems, methods, features and advantages be included within this description, be within the scope of the disclosure, and be protected by the following claims.

BRIEF DESCRIPTION OF THE DRAWINGS

The method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1:
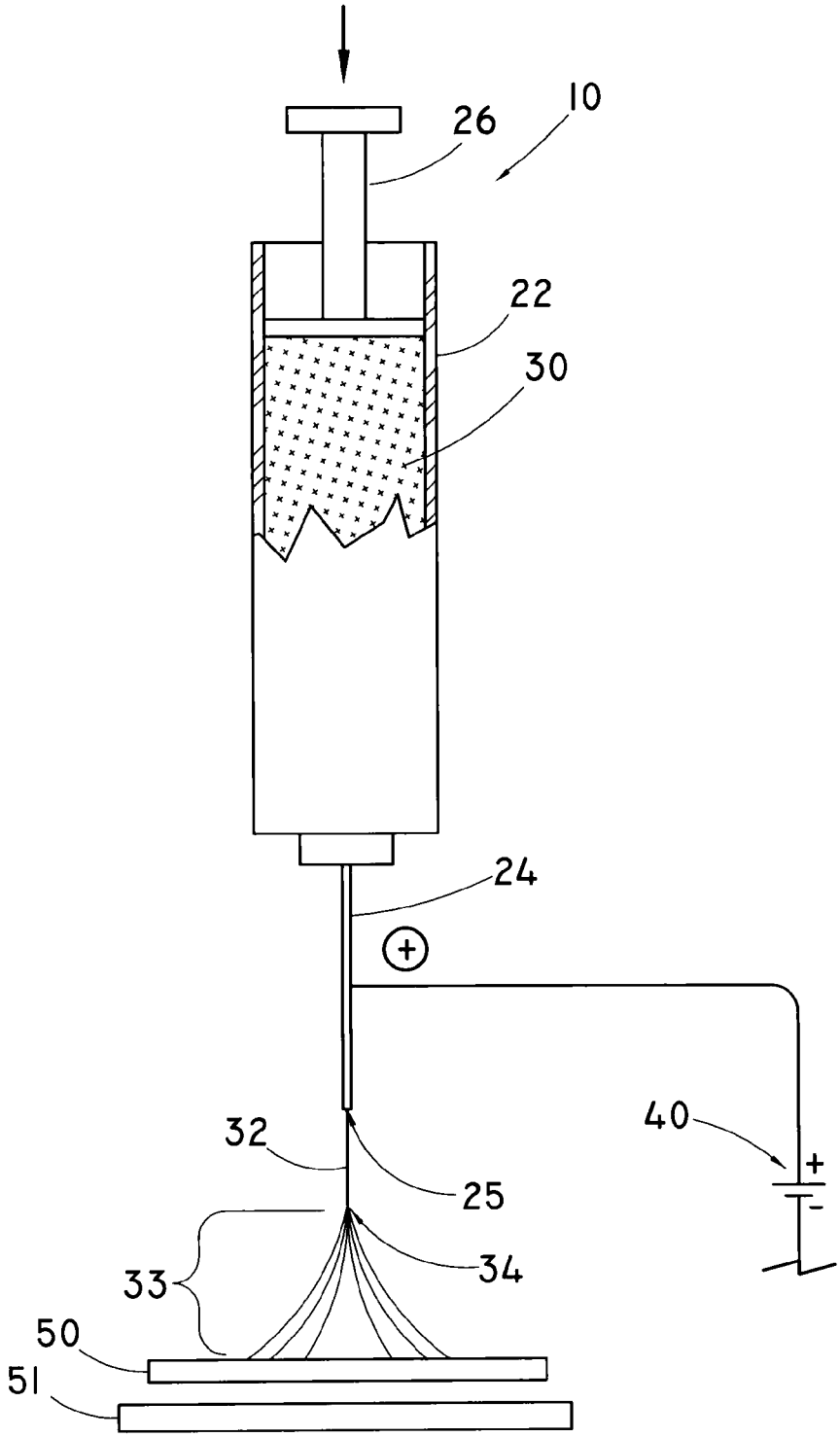
FIG. 1 is a schematic representation of an exemplary electrospinning apparatus.

The present disclosure provides methods of covering endoluminal prostheses, such as stents, using electrospinning. Unless otherwise defined, all technical and scientific terms used herein have the same meaning as commonly understood by one of ordinary skill in the art to which this disclosure pertains. In case of conflict, the present document, including definitions, will control. Preferred methods and materials are described below, although methods and materials similar or equivalent to those described herein can be used in the practice or testing of the present disclosure. All publications, patent applications, patents and other references mentioned herein are incorporated by reference in their entirety. The materials, methods, and examples disclosed herein are illustrative only and not intended to be limiting.

DEFINITIONS

The term "body vessel" means any tube-shaped body passage lumen that conducts fluid, including but not limited to blood vessels such as those of the human vasculature system, esophageal, intestinal, billiary, urethral and ureteral passages.

The term "biocompatible" refers to a material that is substantially non-toxic in the in vivo environment of its intended use, and that is not substantially rejected by the patient's physiological system (i.e., is non-antigenic). This can be gauged by the ability of a material to pass the biocompatibility tests set forth in International Standards Organization (ISO) Standard No. 10993 and/or the U.S. Pharmacopeia (USP) 23 and/or the U.S. Food and Drug Administration (FDA) blue book memorandum No. G95-1, entitled "Use of International Standard ISO-10993, Biological Evaluation of Medical Devices Part 1: Evaluation and Testing." Typically, these tests measure a material's toxicity, infectivity, pyrogenicity, irritation potential, reactivity, hemolytic activity, carcinogenicity and/or immunogenicity. A biocompatible structure or material, when introduced into a majority of patients, will not cause a significantly adverse, long-lived or escalating biological reaction or response, and is distinguished from a mild, transient inflammation which typically accompanies surgery or implantation of foreign objects into a living organism.

The term "hydrophobic" refers to material that tends not to combine with water. One way of observing hydrophobicity is to observe the contact angle formed between a water droplet or solvent and a substrate; the higher the contact angle the more hydrophobic the surface. Generally, if the contact angle of a liquid on a substrate is greater than 90° then the material is said to be hydrophobic.

The term "implantable" refers to an ability of a medical device to be positioned, for any duration of time, at a location within a body, such as within a body vessel. Furthermore, the terms "implantation" and "implanted" refer to the positioning, for any duration of time, of a medical device at a location within a body, such as within a body vessel.

The phrase "controlled release" refers to an adjustment in the rate of release of a bioactive agent from a medical device in a given environment. The rate of a controlled release of a bioactive agent may be constant or vary with time. A controlled release may be characterized by a drug elution profile, which shows the measured rate at which the bioactive agent is removed from a drug-coated device in a given solvent environment as a function of time.

The phrase "bioactive agent" refers to any pharmaceutically active agent that results in an intended therapeutic effect on the body to treat or prevent conditions or diseases. Bioactive agents include any suitable biologically active chemical compounds, biologically derived components such as cells, peptides, antibodies, and polynucleotides, and radiochemical bioactive agents, such as radioisotopes.

An "anti-proliferative" agent/factor/drug includes any protein, peptide, chemical or other molecule that acts to inhibit cell proliferative events. Examples of anti-proliferative agents include microtubule inhibitors such as vinblastine, vincristine, colchicine and paclitaxel, or other agents such as cisplatin.

The term "pharmaceutically acceptable" refers to those compounds of the present disclosure which are, within the scope of sound medical judgment, suitable for use in contact with the tissues of humans and lower mammals without undue toxicity, irritation, and allergic response, are commensurate with a reasonable benefit/risk ratio, and are effective for their intended use, as well as the zwitterionic forms, where possible, of the compounds of the disclosure.

The term "coating," unless otherwise indicated, refers generally to material attached to an implantable medical device prior to implantation. A coating can include material covering any portion of a medical device, and can include one or more coating layers. A coating can have a substantially constant or a varied thickness and composition. Coatings can be adhered to any portion of a medical device surface, including the luminal surface, the abluminal surface, or any portions or combinations thereof.

"Pharmaceutically acceptable salt" means those salts which are, within the scope of sound medical judgment, suitable for use in contact with the tissues of humans and lower animals without undue toxicity, irritation, allergic response and the like, and are commensurate with a reasonable benefit/risk ratio. Pharmaceutically acceptable salts are well known in the art. For example, S. M. Berge et al., describe pharmaceutically acceptable salts in detail in J. Pharm Sciences, 66: 1-19 (1977), which is hereby incorporated by reference.

The term "pharmaceutically acceptable ester" refers to esters which hydrolyze in vivo and include those that break down readily in the human body to leave the parent compound or a salt thereof. Suitable ester groups include, for example, those derived from pharmaceutically acceptable aliphatic carboxylic acids, particularly alkanoic, alkenoic, cycloalkanoic and alkanedioic acids, in which each alkyl or alkenyl moiety advantageously has not more than six carbon atoms. Examples of particular esters includes formates, acetates, propionates, butyates, acrylates and ethylsuccinates.

The term "pharmaceutically acceptable prodrug" refers to those prodrugs of the compounds of the present disclosure which are, within the scope of sound medical judgment, suitable for use in contact with the tissues of humans and lower animals without undue toxicity, irritation, allergic response, and the like, commensurate with a reasonable benefit/risk ratio, and effective for their intended use, as well as the zwitterionic forms, where possible, of the compounds of the disclosure. The term "prodrug" refers to compounds that are rapidly transformed in vivo to provide the parent compound having the above formula, for example by hydrolysis in blood. A thorough discussion is provided in T. Higuchi and V. Stella, Pro-drugs as Novel Delivery Systems, Vol. 14 of the A.C.S. Symposium Series, and in Edward B. Roche, ed., Bioreversible Carriers in Drug Design, American Pharmaceutical Association and Pergamon Press, 1987, both of which are incorporated herein by reference.

Electrospinning

FIG. 1 depicts one example of a method of covering an endoluminal prosthesis, such as a stent, using electrospinning. An electrospinning apparatus 10 is loaded with a solution 30 in a reservoir 22, which is fluidly coupled to an orifice 24, such as a nozzle or needle.

Figure 2A:
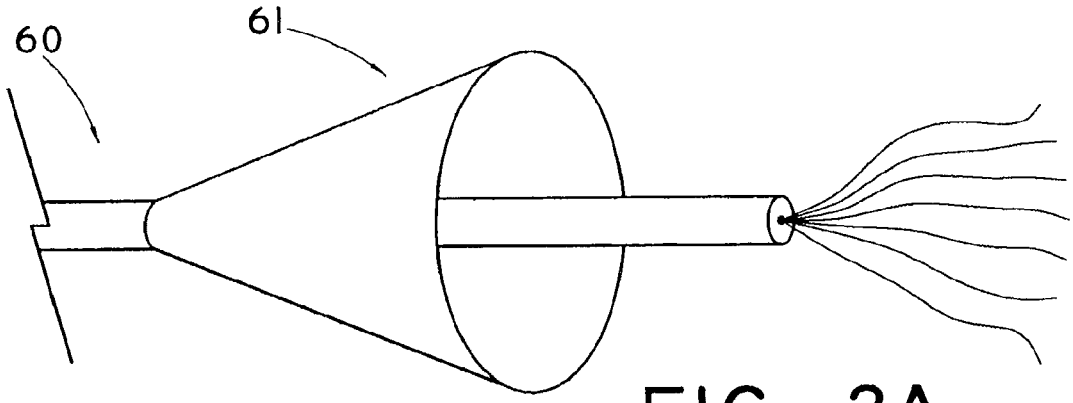
FIGS. 2A and 2B are schematic representations of exemplary nozzle configurations.
Figure 2B:
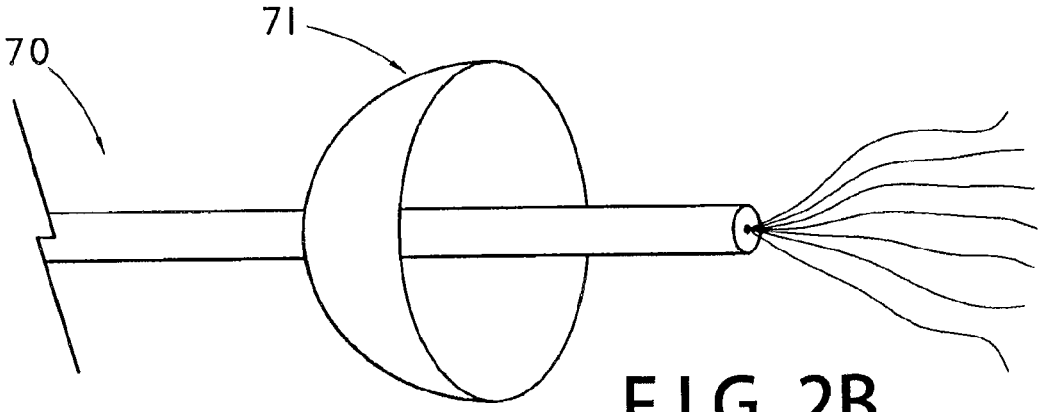

The electrospinning apparatus may have any suitable configuration. For example, the nozzle may comprise a conical or hemispherical configuration. FIG. 2A depicts a nozzle 60 having a conical outer profile 61. FIG. 2B depicts a nozzle 70 having a hemispherical outer profile 71. Modification of the orifice configuration may alter the electrical field and optimize the attractive forces upon the electrospun fibers.

Referring again to FIG. 1, the orifice 24 has a distal opening 25 through which the solution 30 is driven by a displacement system 26. The displacement system 26 may comprise any suitable controllable variable rate fluid displacement system, but is desirably an automated system to ensure consistent and accurate flow rates. For example, in FIG. 1, the displacement system 26 is represented in a simplified manner as being provided by a plunger.

An electric potential 40 is established across the orifice 24 and a target 50. The target 50 is located intermediate the orifice 24 and a ground plane 51. The ground plane 51 is maintained at electrical ground and may further enhance the electrical potential 40. The ground plane 51 may also permit a more uniform coating on the target 50. As the solution exits the orifice distal opening 25, it forms a charged jet or stream 32 to the target 50. The solution stream 32 forms a cone shape 33, called a Taylor cone, between the orifice 24 and the target 50. As the solution stream 32 travels from the opening 25, the cone 33 fractionates at a position 34 between the orifice 24 and the target 50. Position 34 need not be substantially intermediate the orifice distal opening 25 and the target 50, and may be located at any desired distance between the orifice distal opening 25 and the target 50. As the cone 33 fractionates, tiny droplets are formed and drawn into a plurality of fibers. The fibers may stretch as they travel from the opening 25, thereby decreasing the fibers' diameter and increasing the fibers' tensile strength. The plurality of fibers may or may not dry upon reaching the target, depending on the volatility of the chosen solvent.

Method of Manufacture

Figure 3:
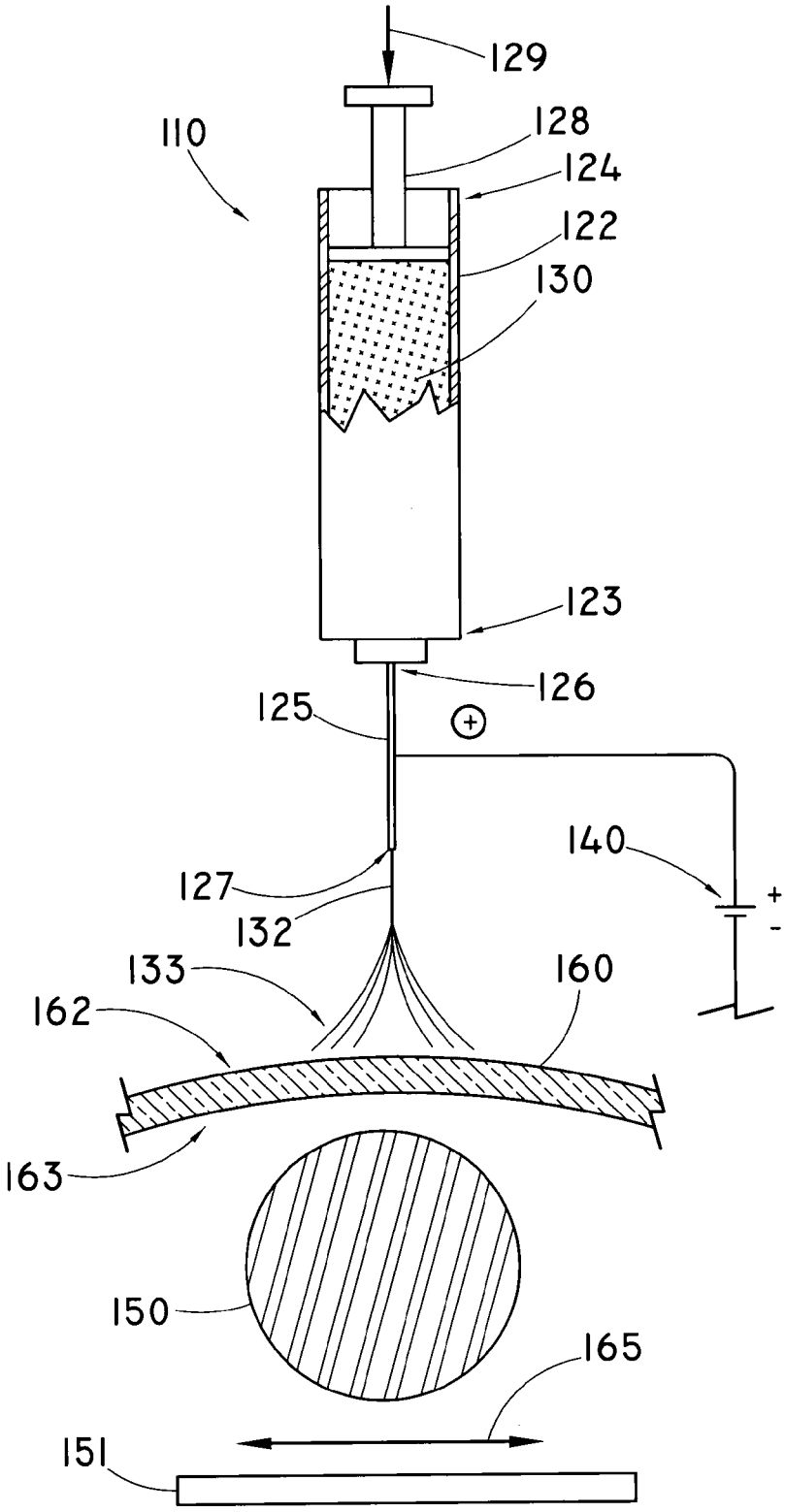
FIG. 3 is a schematic representation of an exemplary electrospinning apparatus.

In one example, an electrospinning apparatus 110 may apply a coating or covering on an endoluminal prosthesis. For example, in FIG. 3, a portion of an endoluminal prosthesis, such as a stent 160, is placed in between a nozzle 125 and a target, such as a mandrel 150. In one example, the distance between the nozzle distal end 127 and the stent 160 is between about 0.1 inches to about 10 inches, between about 0.5 inches to about 8 inches, or between about 1 inch to about 6 inches. The stent 160 includes a first surface 162 and an opposing second surface 163. For example, the first surface may be an outer surface, an exterior surface or an abluminal surface, and the opposing second surface may be an inner surface, an interior surface or a luminal surface. The mandrel 150 is located adjacent the stent second surface 163.

In one example, the mandrel 150 is coated with polytetrafluoroethylene (e.g., PTFE, Teflon®). The PTFE may facilitate removal of the stent 160. It may be desirable to electrically couple the stent 160 to the grounded mandrel 150 where the mandrel 150 is coated with PTFE. For example, a thin wire may be placed on top of the PTFE and may be electrically coupled to ground. The stent 160 is placed on the coated mandrel such that the stent 160 is touching the wire.

The electrospinning apparatus 110 includes a reservoir 122 having a distal end 123 and a proximal end 124. The reservoir is loaded with solution 130 and is fluidly coupled at the reservoir distal end 123 to an orifice, such as nozzle 125, at the nozzle proximal end 126. The reservoir proximal end 124 is fluidly coupled to a displacement system 128, such as a plunger. The nozzle distal end 127 is oriented in the direction of the stent 160. For example, the nozzle distal end 127 may be oriented towards the mandrel 150, around which the stent 160 is located, such that any solution 130 exiting the nozzle distal end 127 is directed towards the mandrel 150. A voltage source 140 is electrically coupled to the nozzle 125 and mandrel 150. A ground plane 151 is maintained at electrical ground and may further enhance the electrical potential 140. The ground plane 151 may also permit a more uniform coating on the stent 160. In one example, the ground plane 151 has a length that is greater than the length of the mandrel 150 and/or stent 160 and a width that is greater than the width of the mandrel 150 and/or stent 160.

The voltage source 140 generates an electric potential between the nozzle 125 and mandrel 150 and ground plane 151. In one example, the electric potential applied by the voltage source is between about 100V and about 35 kV, between about 500V and about 30 kV, or between about 10 kV and about 25 kV. The plunger 128 may be advanced in a distal direction 129, and may urge the solution 130 from the nozzle 125. In one example, the solution 130 may have a delivery rate of about 0 mL/hr to about 25 mL/hr, of about 1 mL/hr to about 10 mL/hr, of about 3 mL/hr to about 7 mL/hr. The electric potential 140 and plunger movement 129 may motivate the solution 130 from the nozzle 125. The solution 130 exits the orifice distal end 127 as a charged solution stream or jet 132. The solution stream 132 is directed towards the endoluminal prosthesis first surface 162. For example, the solution stream 132 may be directed at the mandrel 150 located adjacent the endoluminal prosthesis second surface 163. As the solution stream 132 travels away from the orifice distal end 127 towards the endoluminal prosthesis 160, the solution stream 132 splays 133 before contacting the endoluminal prosthesis first surface 162. The splaying 133 may form a plurality of fibers, such as nanofibers. The fibers contact the endoluminal prosthesis first surface 162 to form a coating of non-woven fibers thereon.

In one example, the distance between the distal opening 127 and the stent 160 and the electric potential 140 are related. An electric potential gradient of about 2,500 to about 3,333 volts per inch is particularly preferred for coating an endoluminal prosthesis using electrospinning. For example, the distal opening 127 may be about 6 inches to about 8 inches from the stent 160 and the electric potential 140 adjusted to about 20 kV; the distal opening 127 may be about 1 inch from the stent 160 and the electric potential 140 adjusted to about 2,500 volts; or the distal opening 127 may be about 0.120 inches from the stent 160 and the electric potential 140 adjusted to about 500 volts. A decreased distance between the distal opening 127 and the stent 160 may permit for more accurate placement of electrospun fibers on the stent surface.

In another example, the orifice may be located about the endoluminal prosthesis second surface and the mandrel may be located adjacent the endoluminal prosthesis first surface. For example, the apparatus configuration of FIG. 3 may be rearranged, with the orifice distal end located about the endoluminal prosthesis second surface and the mandrel adjacent the endoluminal prosthesis first surface. This configuration may permit coating or covering the endoluminal prosthesis second surface with electrospun fibers. In one example, an endoluminal prosthesis second surface may be coated with electrospun fibers from an orifice, such as a nozzle or needle, located axially within the lumen of the endoluminal prosthesis at an electric potential of less than about 1.0 kV.

In another aspect, the endoluminal prosthesis 160 may be moved relative to the nozzle 125 and/or mandrel 150. Movement of the endoluminal prosthesis 160 relative to the nozzle 125 and/or mandrel 150 may permit the coating of any portion of the endoluminal prosthesis first surface 162. For example, the first surface 162 may be coated almost entirely, partially, or at discrete locations. For example, the endoluminal prosthesis 162 may be moved laterally 165 to direct the fibers about the horizontal length of the endoluminal prosthesis first surface 162. The endoluminal prosthesis 162 also may be moved longitudinally to direct the fibers about the vertical, or longitudinal, length (e.g., top to bottom) of the endoluminal prosthesis 162. The endoluminal prosthesis 162 may further be rotated about an axis orthogonal to the orifice 125 to direct fibers circumferentially around the endoluminal prosthesis 162. Alternatively, the endoluminal prosthesis 162 may remain stationary while the nozzle 125 and/or mandrel 150 move relative to the endoluminal prosthesis 160.

The relative motion of the nozzle 125 and endoluminal prosthesis 160 may influence several properties of the resulting coating of fibers. For example, if the nozzle 125 is moved relative to the target 150, for example increasing the distance between the target 150 and nozzle 125, the solution stream 132 will travel a greater distance and may affect the fractionation, stretching, and drying of the solution stream 132.

If the endoluminal prosthesis 160 is moved laterally 165, longitudinally, or rotationally, as the relative speed between the nozzle 125 and endoluminal prosthesis 162 is increased, the thickness of the coating will be reduced, and the fibers may tend to be increasingly aligned with each other. This may affect the strength, resiliency, and porosity of the coating. Porosity, as used herein, refers to the ability of openings, gaps, or holes in a covering to permit bodily fluids to flow therethrough.

For example, as the rate of movement is increased, the size and concentration of gaps or holes between the electrospun fibers increases. A large concentration of large holes will be highly porous compared to a small concentration of small holes. The rate and direction of movement between the nozzle 125 and endoluminal prosthesis 162 may be controlled to create varying porosity about the endoluminal prosthesis covering. In one example, the rate of movement is increased at the endoluminal prosthesis proximal and distal ends and decreased about the prosthesis middle portion. The covered endoluminal prosthesis may thereby be porous at the proximal and distal ends, permitting fluid, such as blood, to circulate, and non-porous about the middle portion, substantially preventing fluid flow.

Figure 4:
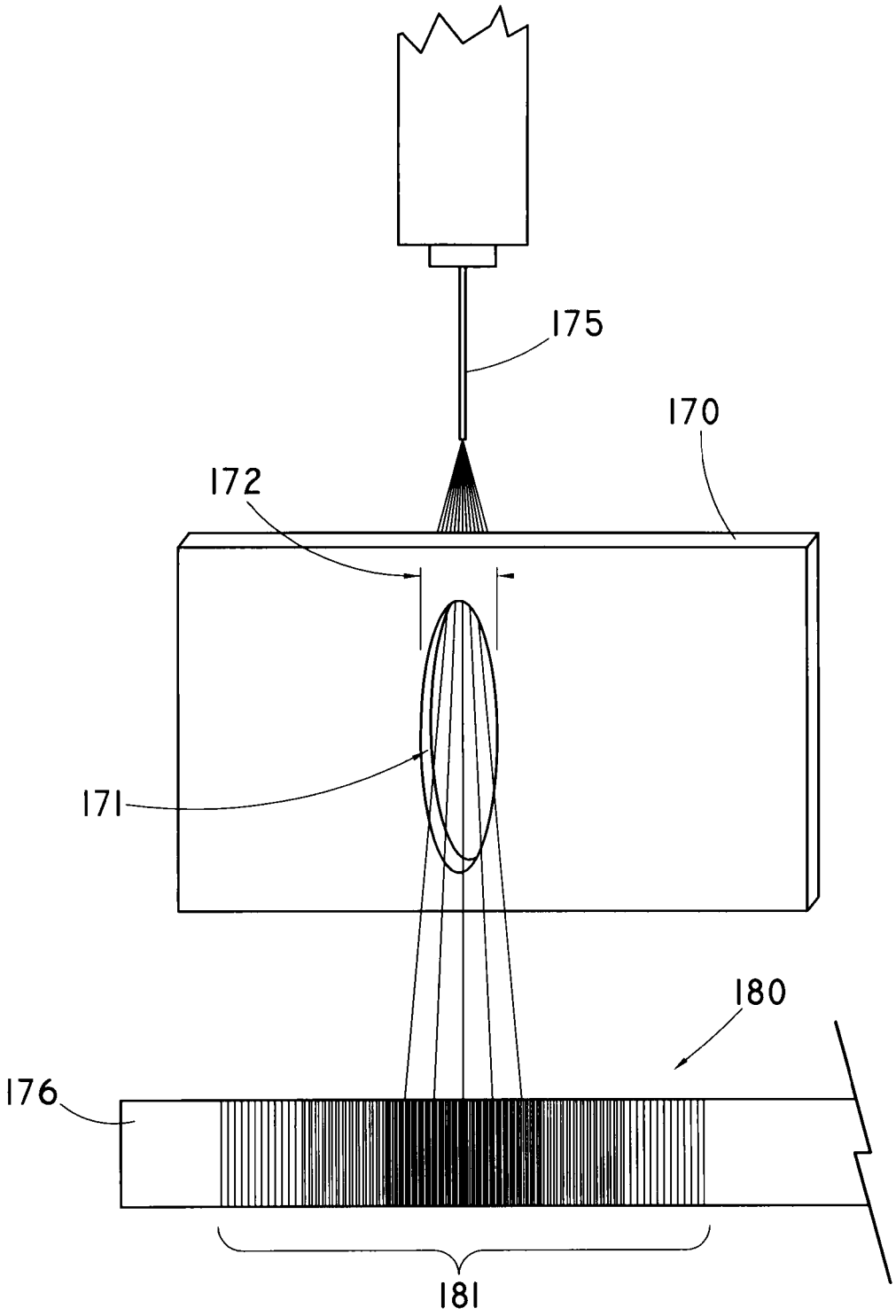
FIG. 4 is a schematic representation of an exemplary electrospinning apparatus including a mask.

The density and placement of electrospun fibers on an endoluminal prosthesis may also be controlled by the use of an aperture mask. For example, FIG. 4 depicts a mask 170 positioned between an orifice, such as a needle 175, and an endolulminal prosthesis, such as a stent 180, located about a mandrel 176. The mask 170 may be positioned at any suitable position between the needle 175 and the stent 180. For example, the mask 170 may be positioned approximately midway between the needle 175 and the stent 180. The mask 170 may be about 4 inches from the needle 175 and the stent 180 when the needle 175 and stent 180 are about 8 inches from one another. The mask 170 may comprise metallic or polymeric material.

In one example, the mask 170 comprises aluminum. The mask 170 includes an oval-shaped aperture 171 having a width 172 equal to about 25% of the longitudinal length of the stent 181. A voltage source (not shown) is electrically coupled to the needle 175 and mandrel 176.

In one example, the electric potential applied by the voltage source is about 20 kV—the needle 175 at about 20 kV and the mandrel 176 at about ground, or 0 volts. The voltage source may apply an electrical potential to the mask 170 of between about 0 volts to about 20 kV, between about 2 kV to about 18 kV, between about 8 kV to about 14 kV. In a particular example, the mask 170 has an electrical potential of about 12 kV.

Figure 5A:
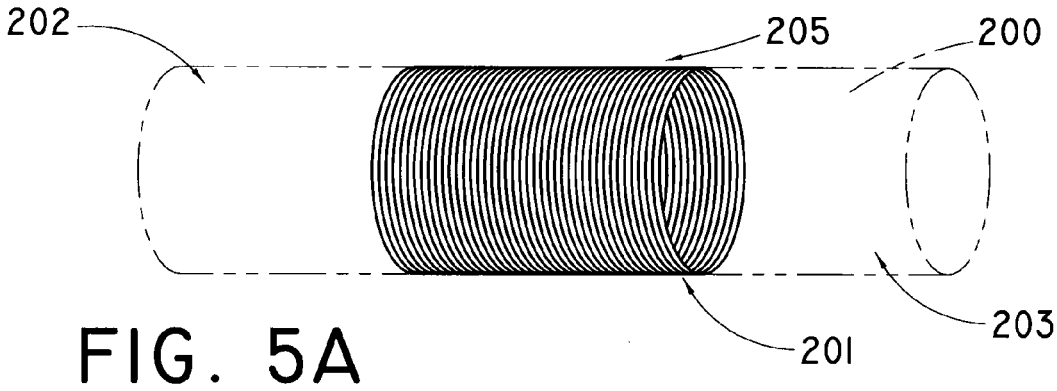
FIGS. 5A-5D are perspective illustrations of endoluminal prosthesis coated with electrospun fibers.
Figure 5B:
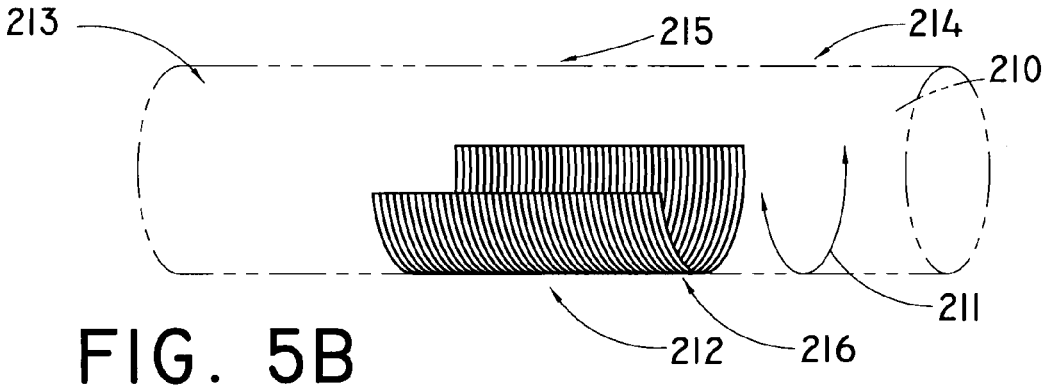
Figure 5C:
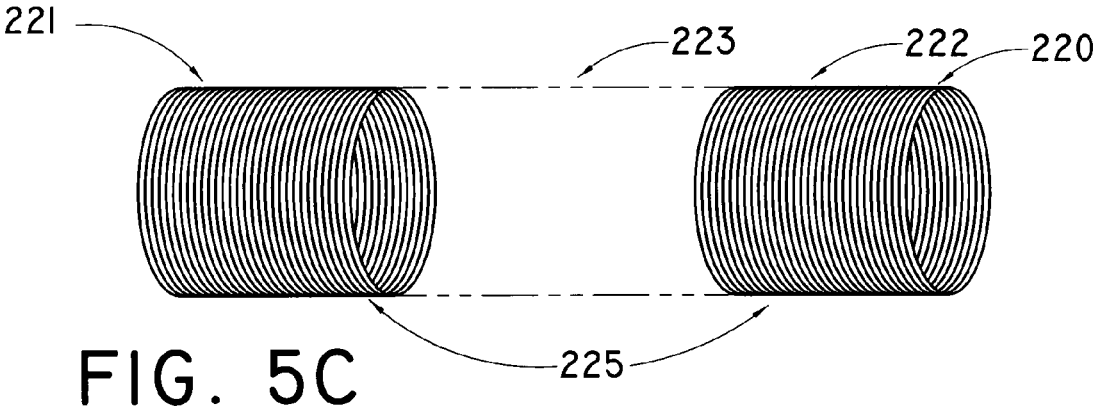

The aperture 171 allows for the narrow deposition of fibers onto the stent 180 about a desired location. For example, FIGS. 5A-5C depict exemplary stents coated with electrospun fibers at desired locations about the stent. FIG. 5A depicts a stent 200 with electrospun fibers 205 covering the middle portion 201 of the stent 200. The stent ends 202, 203 are not coated with electrospun fibers. FIG. 5B depicts a stent 210 with electrospun fibers 216 covering only about half of the circumferential length 211 of the middle portion 212 of the stent 210. The stent ends 213, 214 as well as a part 215 of the middle portion 212 are not coated with electrospun fibers. FIG. 5C depicts a stent 220 with electrospun fibers 225 covering the stent proximal end 221 and distal end 222. The stent middle portion 223 is not coated.

Though the mask 170 is depicted having an oval-shaped aperture 171, the aperture may have any desired configuration, including but not limited to round, obround, polygonal, rectangular, square, freeform, or combinations thereof. Additionally, the aperture may have any suitable dimensions.

The aperture may become obstructed during electrospinning. For example, the fibers may create a "net," thereby preventing electrospun fibers from passing through the aperture. The obstruction may be cleared by blowing gas, such as nitrogen or air, through the aperture to clear any obstruction during electrospinning.

In one example, movement of the stent 180 with respect to the aperture 171 may allow for further control of the fiber density and concentration. For example, rotating, horizontally moving, and/or longitudinally moving the mandrel 176, about which the stent 180 is located, allows the stent 180 to be coated with varying fiber density and concentration. Decreasing the rate of movement of the mandrel 176 when in front of the aperture 171 will result in increased coating thickness, increased fiber density, and/or decreased porosity. Increasing the rate of movement of the mandrel 176 when in front of the aperture 171 will result in decreased coating thickness, decreased fiber density, and/or increased porosity.

Figure 5D:
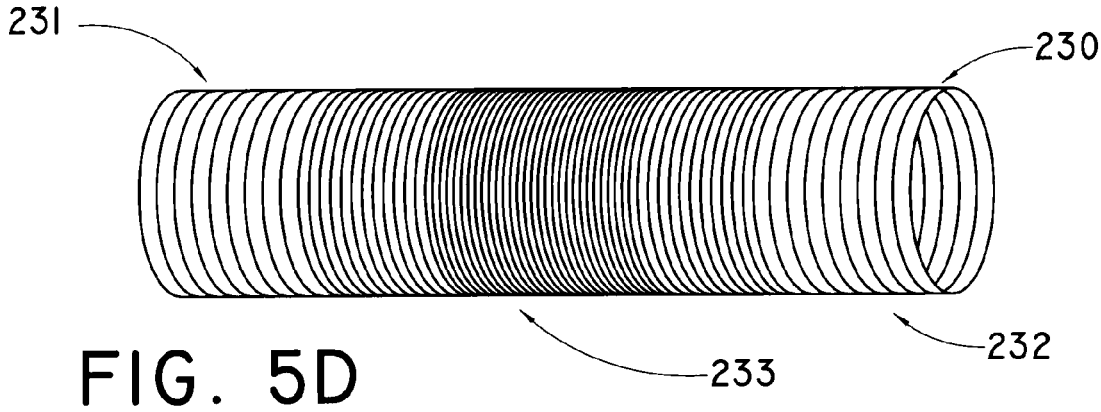

For example, FIG. 5D depicts a stent 230 comprising an electrospun coating having varying density, where the stent proximal 231 and distal 232 ends were passed more rapidly in front of an aperture during electrospinning compared to the stent middle 233. Accordingly, the stent proximal 231 and distal 232 ends have a coating density and fiber concentration that is less than the stent middle portion 233. The stent proximal 231 and distal 232 ends may also have a porosity that is greater than the stent middle portion 233 coating density.

Solutions

Solutions for use in the present disclosure may include any liquids containing materials to be electrospun. For example, solutions may include, but are not limited to, suspensions, emulsions, melts, and hydrated gels containing the materials, substances, or compounds to be electrospun. Solutions may further include solvents or other liquids or carrier molecules.

Materials appropriate for electrospinning may include any compound, molecule, substance, or group or combination thereof that forms any type of structure or group of structures during or after electrospinning. For example, materials may include natural materials, synthetic materials, or combinations thereof. Naturally occurring organic materials include any substances naturally found in the body of plants or other organisms, regardless of whether those materials have or can be produced or altered synthetically. Synthetic materials include any materials prepared through any method of artificial synthesis, processing, or manufacture. In one example the materials are biologically compatible materials.

One class of materials for electrospinning comprises proteins, such as extracellular matrix (ECM) proteins. ECM proteins include, but are not limited to, collagen, fibrin, elastin, laminin, and fibronectin. In one example, the protein is collagen of any type. Additional materials include further ECM components, for example proteoglycans.

Proteins, as used herein, refer to their broadest definition and encompass the various isoforms that are commonly recognized to exist within the different families of proteins and other molecules. There are multiple types of each of these proteins and molecules that are naturally occurring, as well as types that can be or are synthetically manufactured or produced by genetic engineering. For example, collagen occurs in many forms and types and all of these types and subsets are encompassed herein.

The term protein, and any term used to define a specific protein or class of proteins further includes, but is not limited to, fragments, analogs, conservative amino acid substitutions, non-conservative amino acid substitutions and substitutions with non-naturally occurring amino acids with respect to a protein or type or class of proteins. For example, the term collagen includes, but is not limited to, fragments, analogs, conservative amino acid substitutions, and substitutions with non-naturally occurring amino acids or residues with respect to any type or class of collagen. The term "residue" is used herein to refer to an amino acid (D or L) or an amino acid mimetic that is incorporated into a protein by an amide bond. As such, the residue can be a naturally occurring amino acid or, unless otherwise limited, can encompass known analogs of natural amino acids that function in a manner similar to the naturally occurring amino acids (i.e., amino acid mimetics).

Furthermore, as discussed above, individual substitutions, deletions or additions which alter, add or delete a single amino acid or a small percentage of amino acids (preferably less than 10%, more preferably less than 5%) in an encoded sequence are conservatively modified variations where the alterations result in the substitution of an amino acid with a chemically similar amino acid.

It is to be understood that the term protein, polypeptide or peptide further includes fragments that may be 90% to 95% of the entire amino acid sequence, as well as extensions to the entire amino acid sequence that are 5% to 10% longer than the amino acid sequence of the protein, polypeptide or peptide.

In one example, the solution may comprise synthetic materials, such as biologically compatible synthetic materials. For example, synthetic materials may include polymers. Such polymers include but are not limited to the following: poly (urethanes), poly(siloxanes) or silicones, poly(ethylene), poly(vinyl pyrrolidone), poly(2-hydroxy ethyl methacrylate), poly(N-vinyl pyrrolidone), poly(methyl methacrylate), poly (vinyl alcohol), poly(acrylic acid), polyacrylamide, poly(ethylene-co-vinyl acetate), poly(ethylene glycol), poly(methacrylic acid), polylactides (PLA), polyglycolides (PGA), poly(lactide-co-glycolid-es) (PLGA), polyanhydrides, and polyorthoesters or any other similar synthetic polymers that may be developed that are biologically compatible. Biologically compatible synthetic polymers further include copolymers and blends, and any other combinations of the forgoing either together or with other polymers generally. The use of these polymers will depend on given applications and specifications required.

Solutions may also include electrospun materials that are capable of changing into different materials during or after electrospinning. For example, procollagen will form collagen when combined with procollagen peptidase. Procollagen, procollagen peptidase, and collagen are all within the definition of materials. Similarly, the protein fibrinogen, when combined with thrombin, forms fibrin. Fibrinogen or thrombin that are electrospun as well as the fibrin that later forms are included within the definition of materials.

Solutions may comprise any solvent that allows delivery of the material or substance to the orifice, tip of a syringe, or other site from which the material will be electrospun. The solvent may be used for dissolving or suspending the material or the substance to be electrospun. For example, solvents used for electrospinning have the principal role of creating a mixture with collagen and/or other materials to be electrospun, such that electrospinning is feasible.

The concentration of a given solvent is often an important consideration in electrospinning. In electrospinning, interactions between molecules of materials stabilize the solution stream, leading to fiber formation. The solvent should sufficiently dissolve or disperse the polymer to prevent the solution stream from disintegrating into droplets and should thereby allow formation of a stable stream in the form of a fiber. In one example, the solution has a concentration of about 0.005 g/mL to about 0.15 g/mL, about 0.01 g/mL to about 0.12 g/mL, or about 0.04 g/mL to about 0.09 g/mL.

Solvents useful for dissolving or suspending a material or a substance depend on the material or substance. For example, collagen can be electrodeposited as a solution or suspension in water, 2,2,2-trifluoroethanol, 1,1,1,3,3,3-hexafluoro-2-propanol (also known as hexafluoroisopropanol or HFIP), or combinations thereof. Fibrin monomer can be electrospun from solvents such as urea, monochloroacetic acid, water, 2,2,2-trifluoroethanol, HFIP, or combinations thereof. Elastin can be electrodeposited as a solution or suspension in water, 2,2,2-trifluoroethanol, isopropanol, HFIP, or combinations thereof, such as isopropanol and water.

Other lower order alcohols, especially halogenated alcohols, may be used. Additional solvents that may be used or combined with other solvents include acetamide, N-methylformamide, N,N-dimethylformamide (DMF), dimethylsulfoxide (DMSO), dimethylacetamide, N-methyl pyrrolidone (NMP), acetic acid, trifluoroacetic acid, ethyl acetate, acetonitrile, trifluoroacetic anhydride, 1,1,1-trifluoroacetone, maleic acid, hexafluoroacetone.

Proteins and peptides associated with membranes are often hydrophobic and thus do not dissolve readily in aqueous solutions. Such proteins can be dissolved in organic solvents such as methanol, chloroform, and trifluoroethanol (TFE) and emulsifying agents. Any other solvents may be used, for example, solvents useful in chromatography, especially high performance liquid chromatography. Proteins and peptides are also soluble, for example, in HFIP, hexafluoroacetone, chloroalcohols in conjugation with aqueous solutions of mineral acids, dimethylacetamide containing 5% lithium chloride, and in acids such as acetic acid, hydrochloric acid and formic acid. In some aspects, the acids are very dilute, in others the acids are concentrated. N-methyl morpholine-N-oxide is another solvent that can be used with many polypeptides. Other compounds, used either alone or in combination with organic acids or salts, include the following: triethanolamine; dichloromethane; methylene chloride; 1,4-dioxane; acetonitrile; ethylene glycol; diethylene glycol; ethyl acetate; glycerine; propane-1,3-diol; furan; tetrahydrofuran; indole; piperazine; pyrrole; pyrrolidone; 2-pyrrolidone; pyridine; quinoline; tetrahydroquinoline; pyrazole; and imidazole. Combinations of solvents may also be used.

Synthetic polymers may be electrospun from, for example, HFIP, methylene chloride, ethyl acetate; acetone, 2-butanone (methyl ethyl ketone), diethyl ether; ethanol; cyclohexane; water; dichloromethane (methylene chloride); tetrahydrofuran; dimethylsulfoxide (DMSO); acetonitrile; methyl formate and various solvent mixtures. HFIP and methylene chloride are desirable solvents. Selection of a solvent will depend upon the characteristics of the synthetic polymer to be electrodeposited.

Selection of a solvent, for example, is based in part on consideration of secondary forces that stabilize polymer-polymer interactions and the solvent's ability to replace these with strong polymer-solvent interactions. In the case of polypeptides such as collagen, and in the absence of covalent crosslinking, the principal secondary forces between chains are: (1) coulombic, resulting from attraction of fixed charges on the backbone and dictated by the primary structure (e.g., lysine and arginine residues will be positively charged at physiological pH, while aspartic or glutamic acid residues will be negatively charged); (2) dipole-dipole, resulting from interactions of permanent dipoles; the hydrogen bond, commonly found in polypeptides, is the strongest of such interactions; and (3) hydrophobic interactions, resulting from association of non-polar regions of the polypeptide due to a low tendency of non-polar species to interact favorably with polar water molecules. Solvents or solvent combinations that can favorably compete for these interactions can dissolve or disperse polypeptides. For example, HFIP and TFE possess a highly polar OH bond adjacent to a very hydrophobic fluorinated region. Additionally, the hydrophobic portions of these solvents can interact with hydrophobic domains in polypeptides, helping to resist the tendency of the latter to aggregate via hydrophobic interactions. In some examples, solvents are selected based on their tendency to induce helical structure in electrospun protein fibers, thereby predisposing monomers of collagen or other proteins to undergo polymerization and form helical polymers that mimic the native collagen fibril. Examples of such solvents include halogenated alcohols, preferably fluorinated alcohols (HFIP and TFE) hexafluoroacetone, chloroalcohols in conjugation with aqueous solutions of mineral acids and dimethylacetamide, preferably containing lithium chloride. HFIP and TFE are especially preferred. In some examples, water is added to the solvents.

The solvent, moreover, may have a relatively high vapor pressure to promote the stabilization of an electrospinning solution stream to create a fiber as the solvent evaporates. In examples involving higher boiling point solvents, it is often desirable to facilitate solvent evaporation by warming the spinning solution, and optionally the solution stream itself, or by electrospinning in reduced atmospheric pressure.

In one example, the solution comprises polyethylene terephthalate (e.g., Dacron®) dissolved in trifluoroacetic acid. The solution may further comprise a dampening agent, such as dichloromethane. A dampening agent may lower the solution's viscosity and permit for the formation of smaller fibers.

Bioactive Agents

In one example, a solution for electrospinning may further comprise bioactive materials, for example a therapeutically effective amount of one or more bioactive agents in pure form or in derivative form. Preferably, the derivative form is a pharmaceutically acceptable salt, ester or prodrug form. Alternatively, an endoluminal prosthesis may be implanted in combination with the administration of a bioactive agent from a catheter positioned within the body near the endoluminal prosthesis, before, during or after implantation of the prosthesis.

Bioactive agents that may be used in the present disclosure include, but are not limited to, pharmaceutically acceptable compositions containing any of the bioactive agents or classes of bioactive agents listed herein, as well as any salts and/or pharmaceutically acceptable formulations thereof.

The bioactive agent may be coated on any suitable part of the endoluminal prosthesis. Selection of the type of bioactive agent and the portions of the endoluminal prosthesis comprising the bioactive agent may be chosen to perform a desired function upon implantation. For example, the bioactive agent may be selected to treat indications such as coronary artery angioplasty, renal artery angioplasty, carotid artery surgery, renal dialysis fistulae stenosis, or vascular graft stenosis.

The bioactive agent may be selected to perform one or more desired biological functions. For example, the abluminal surface of the endoluminal prosthesis may comprise a bioactive agent selected to promote the ingrowth of tissue from the interior wall of a body vessel, such as a growth factor. An anti-angiogenic or antineoplastic bioactive agent such as paclitaxel, sirolimus, or a rapamycin analog, or a metalloproteinase inhibitor such as batimastaat may be coated on the endoluminal prosthesis to mitigate or prevent undesired conditions in the vessel wall, such as restenosis. Many other types of bioactive agents can be coated on the endoluminal prosthesis.

Bioactive agents for use in electrospinning solutions of the present disclosure include those suitable for coating an implantable endoluminal prosthesis. The bioactive agent can include, for example, one or more of the following: antiproliferative agents (sirolimus, paclitaxel, actinomycin D, cyclosporine), immunomodulating drugs (tacrolimus, dexamethasone), metalloproteinase inhibitors (such as batimastat), antisclerosing agents (such as collagenases, halofuginone), prohealing drugs (nitric oxide donors, estradiols), mast cell inhibitors and molecular interventional bioactive agents such as c-myc antisense compounds, thromboresistant agents, thrombolytic agents, antibiotic agents, anti-tumor agents, antiviral agents, anti-angiogenic agents, angiogenic agents, anti-mitotic agents, anti-inflammatory agents, angiostatin agents, endostatin agents, cell cycle regulating agents, genetic agents, including hormones such as estrogen, their homologs, derivatives, fragments, pharmaceutical salts and combinations thereof. Other useful bioactive agents include, for example, viral vectors and growth hormones such as Fibroblast Growth Factor and Transforming Growth Factor-β.

Endoluminal prostheses comprising an antithrombogenic bioactive agent are particularly preferred for implantation in areas of the body that contact blood. For example, an antithromogenic bioactive agent can be coated on the prosthesis surface. An antithrombogenic bioactive agent is any bioactive agent that inhibits or prevents thrombus formation within a body vessel. The endoluminal prosthesis may comprise any suitable antithrombogenic bioactive agent. Types of antithrombotic bioactive agents include anticoagulants, antiplatelets, and fibrinolytics. Anticoagulants are bioactive agents which act on any of the factors, cofactors, activated factors, or activated cofactors in the biochemical cascade and inhibit the synthesis of fibrin. Antiplatelet bioactive agents inhibit the adhesion, activation, and aggregation of platelets, which are key components of thrombi and play an important role in thrombosis. Fibrinolytic bioactive agents enhance the fibrinolytic cascade or otherwise aid in dissolution of a thrombus. Examples of antithrombotics include but are not limited to anticoagulants such as antithrombin and tissue factor inhibitors; antiplatelets such as glycoprotein IIb/IIIa, thromboxane A2, ADP-induced glycoprotein IIb/IIIa, and phosphodiesterase inhibitors; and fibrinolytics such as plasminogen activators, thrombin activatable fibrinolysis inhibitor (TAFI) inhibitors, and other enzymes which cleave fibrin.

Further examples of antithrombotic bioactive agents include anticoagulants such as heparin, low molecular weight heparin, covalent heparin, synthetic heparin salts, coumadin, bivalirudin (hirulog), hirudin, argatroban, ximelagatran, dabigatran, dabigatran etexilate, D-phenalanyl-L-poly-L-arginyl, chloromethy ketone, dalteparin, enoxaparin, nadroparin, danaparoid, vapiprost, dextran, dipyridamole, omega-3 fatty acids, vitronectin receptor antagonists, DX-9065a, CI-1083, JTV-803, razaxaban, BAY 59-7939, and LY-51, 7717; antiplatelets such as eftibatide, tirofiban, orbofiban, lotrafiban, abciximab, aspirin, ticlopidine, clopidogrel, cilostazol, dipyradimole, nitric oxide sources such as sodium nitroprussiate, nitroglycerin, S-nitroso and N-nitroso compounds; fibrinolytics such as alfimeprase, alteplase, anistreplase, reteplase, lanoteplase, monteplase, tenecteplase, urokinase, streptokinase, or phospholipid encapsulated microbubbles; and other bioactive agents such as endothelial progenitor cells or endothelial cells.

Also particularly preferred are solutions comprising a thrombolytic bioactive agent. Desirably, the thrombolytic bioactive agent is coated on the luminal surface of the endoluminal prosthesis. Thrombolytic agents are used to dissolve blood clots that may adversely affect blood flow in body vessels. A thrombolytic agent is any therapeutic agent that either digests fibrin fibers directly or activates the natural mechanisms for doing so. The endoluminal prosthesis can comprise any suitable thrombolytic agent. Examples of commercial thrombolytics, with the corresponding active agent in parenthesis, include, but are not limited to, Abbokinase (urokinase), Abbokinase Open-Cath (urokinase), Activase (alteplase, recombinant), Eminase (anitstreplase), Retavase (reteplase, recombinant), and Streptase (streptokinase). Other commonly used names are anisoylated plasminogen-streptokinase activator complex; APSAC; tissue-type plasminogen activator (recombinant); t-PA; rt-PA.

The configuration of the bioactive agent on the endoluminal prosthesis will depend in part on the desired rate of elution for the bioactive agent(s). For example, bioactive agents may be incorporated in the endoluminal prosthesis by: 1) mixing a bioactive agent with a solution prior to spinning the solution; 2) using two orifices to spin a polymer and a bioactive agent separately and simultaneously, 3) impregnating a spun polymer with a bioactive agent, and 4) electrospinning a solution over the top of a bioactive agent coated endoluminal prosthesis.

In one example, a bioactive agent may be admixed with a solution comprising polymers and/or proteins. Electrospinning the resulting solution yields fibers that contain the desired bioactive agents. This method may be particularly suited to creating fibers that are not susceptible to being rejected by the body. Additionally, the fibers may later be melted, compressed, or otherwise manipulated, thereby changing or eliminating the interstices between the fibers, without reducing the drug content of the fibers.

In a second example, two orifices may be used in close proximity to each other, each having a common target. A first reservoir coupled to a first orifice may be loaded with a solution comprising polymers and a second reservoir coupled to a second orifice may be loaded with a solution comprising at least one bioactive agent. The orifices are charged and their solutions are spun simultaneously at the common target, creating a material that includes polymer fibers and bioactive agent fibers. The bioactive agent being fed into the second orifice may also be mixed with a second polymer to improve the spin characteristics of the bioactive agent.

In another example, a solution may be electrospun onto a endoluminal prosthesis incorporating a bioactive agent. For example, the endoluminal prosthesis may be initially coated with a bioactive agent in any suitable manner. The endoluminal prosthesis may then be coated by electrospinning a solution, such that the electrospun solution creates a non-woven network of fibers that at least partially overlays the bioactive agent previously deposited on the endoluminal prosthesis. The bioactive agent may be deposited on the endoluminal prosthesis in any suitable manner. For example, the coating may be deposited onto the endoluminal prosthesis by spraying, dipping, pouring, pumping, brushing, wiping, ultrasonic deposition, vacuum deposition, vapor deposition, plasma deposition, electrostatic deposition, epitaxial growth, or any other suitable method.

The therapeutically effective amount of bioactive agent that is provided in connection with the various examples ultimately depends upon the condition and severity of the condition to be treated; the type and activity of the specific bioactive agent employed; the method by which the endoluminal prosthesis is administered to the patient; the age, body weight, general health, gender and diet of the patient; the time of administration, route of administration, and rate of excretion of the specific compound employed; the duration of the treatment; drugs used in combination or coincidental with the specific compound employed; and like factors well known in the medical arts.

Local administration of bioactive agents may be more effective when carried out over an extended period of time, such as a time period at least matching the normal reaction time of the body to an angioplasty procedure. At the same time, it may be desirable to provide an initial high dose of the bioactive agent over a preliminary period. For example, local administration of a bioactive agent over a period of days or even months may be most effective in treating or inhibiting conditions such as restenosis.

Endoluminal Prostheses

The present disclosure is applicable to implantable or insertable endoluminal prostheses of any shape or configuration. Typical subjects (also referred to herein as "patients") are vertebrate subjects (i.e., members of the subphylum cordata), including, mammals such as cattle, sheep, pigs, goats, horses, dogs, cats and humans.

Typical sites for placement of the endoluminal prostheses include the coronary and peripheral vasculature (collectively referred to herein as the vasculature), heart, esophagus, trachea, colon, gastrointestinal tract, biliary tract, urinary tract, bladder, prostate, thorax, brain, wounds and surgical sites.

The endoluminal prosthesis may be any device that is introduced temporarily or permanently into the body for the prophylaxis or treatment of a medical condition. For example, such endoluminal prostheses may include, but are not limited to, stents, stent grafts, vascular grafts, catheters, guide wires, balloons, filters (e.g., vena cava filters), cerebral aneurysm filler coils, intraluminal paving systems, sutures, staples, anastomosis devices, vertebral disks, bone pins, suture anchors, hemostatic barriers, clamps, screws, plates, clips, slings, vascular implants, tissue adhesives and sealants, tissue scaffolds, hernia meshes, skin grafts, myocardial plugs, pacemaker leads, valves (e.g., venous valves), abdominal aortic aneurysm (AAA) grafts, embolic coils, various types of dressings (e.g., wound dressings), bone substitutes, intraluminal devices, vascular supports, or other known bio-compatible devices.

The endoluminal prosthesis may be made of one or more suitable biocompatible materials such as stainless steel, nitinol, MP35N, gold, tantalum, platinum or platinum iridium, niobium, tungsten, iconel, ceramic, nickel, titanium, stainless steel/titanium composite, cobalt, chromium, cobalt/chromium alloys, magnesium, aluminum, or other biocompatible metals and/or composites or alloys such as carbon or carbon fiber, cellulose acetate, cellulose nitrate, silicone, cross-linked polyvinyl alcohol (PVA) hydrogel, cross-linked PVA hydrogel foam, polyurethane, polyamide, styrene isobutylene-styrene block copolymer (Kraton), polyethylene teraphthalate, polyurethane, polyamide, polyester, polyorthoester, polyanhydride, polyether sulfone, polycarbonate, polypropylene, high molecular weight polyethylene, polytetrafluoroethylene, or other biocompatible polymeric material, or mixture of copolymers thereof; polyesters such as, polylactic acid, polyglycolic acid or copolymers thereof, a polyanhydride, polycaprolactone, polyhydroxybutyrate valerate or other biodegradable polymer, or mixtures or copolymers thereof; extracellular matrix components, proteins, collagen, fibrin or other therapeutic agent, or mixtures thereof.

It may be advantageous to prepare the surface of an endoluminal prosthesis before electrospinning or otherwise depositing a coating thereon. Useful methods of surface preparation may include, but are not limited to: cleaning; physical modifications such as etching, drilling, cutting, or abrasion; chemical modifications such as solvent treatment; application of primer coatings or surfactants; plasma treatment; ion bombardment; and covalent bonding. Such surface preparation may activate the surface and promote the deposition or adhesion of the coating on the surface. Surface preparation may also selectively alter the release rate of a bioactive material. Any additional coating layers may similarly be processed to promote the deposition or adhesion of another layer, to further control the release rate of a bioactive agent, or to otherwise improve the biocompatibility of the surface of the layers. For example, plasma treating an additional coating layer before depositing a bioactive agent thereon may improve the adhesion of the bioactive agent, increase the amount of bioactive agent that can be deposited, and allow the bioactive material to be deposited in a more uniform layer.

A primer layer, or adhesion promotion layer, may be used with the endoluminal prosthesis. This layer may include, for example, silane, acrylate polymer/copolymer, acrylate carboxyl and/or hydroxyl copolymer, polyvinylpyrrolidone/vinylacetate copolymer, olefin acrylic acid copolymer, ethylene acrylic acid copolymer, epoxy polymer, polyethylene glycol, polyethylene oxide, polyvinylpyridine copolymers, polyamide polymers/copolymers polyimide polymers/copolymers, ethylene vinylacetate copolymer and/or polyether sulfones.

EXAMPLES

Example 1

Dacron Electrospinning

Five electrospinning trials were performed according to the experimental set-up described in Table 1, below. Trials 1-3 resulted in a circular-shaped, electrospun Dacron-coating deposited on the ground plane. Trial 4 produced a lumen of Dacron fibers between the mask aperture and the ground plane. Trial 5, following the formation of a Dacron droplet on the distal end of the needle prior to application of the electric potential, produced a diffuse lumen of Dacron fibers between the mask aperture and the ground plane.

TABLE 1

| Trial # | kV needle | kV mask | Needle to Mask Distance | Mask to Ground Plane Distance | Mask Aperture Diameter | Total Spin Time | Interval of 5" $N_2$ blast into aperture |
|---|---|---|---|---|---|---|---|
| 1 | 20 kV | 10 kV | 2.5 cm | 2.5 cm | 0.25" | 5 min. | Every 30 seconds |
| 2 | 20 kV | 10 kV | 1.5 cm | 2.0 cm | 0.25" | 3 min. | Every 30 seconds |
| 3 | 20 kV | 10 kV | 1.5 cm | 2.5 cm | 0.375" | 3 min. | Every 30 seconds |
| 4 | 20 kV | 10 kV | 1.5 cm | 2.5 cm | 0.375" | 3 min. | Continuous |
| 5 | 20 kV | 10 kV | 1.5 cm | 2.5 cm | 0.375" | 3 min. | No $N_2$ flow |

The electrospun lumen of trials 4 and 5 represents the possibility of forming 3-dimensional objects using a stream of gas, such as nitrogen, to direct the flow of electrospun fibers without the use of a mandrel on which to shape the assembly of fibers.

While various aspects and examples have been described, it will be apparent to those of ordinary skill in the art that many more examples and implementations are possible within the scope of the disclosure. Accordingly, the disclosure is not to be restricted except in light of the attached claims and their equivalents.

We claim:

1. A method for electrospinning comprising:

providing a target and an electrospinning apparatus;

the target comprising a first surface and an opposing second surface;

the electrospinning apparatus comprising a mandrel, a mask including an aperture, a reservoir loaded with a solution, an orifice fluidly coupled to the reservoir, an energy source electrically coupled to the orifice and the mandrel and further comprising applying a first electrical potential with the energy source between the orifice and the mandrel and a second electrical potential to the mask where the second electrical potential is less that the first electrical potential;

locating the mandrel adjacent the target second surface, locating the orifice at a distance from the target first surface, and locating the mask intermediate the orifice and the target first surface;

electrospinning the solution through the mask aperture onto the target first surface; and where the first electrical potential is between about 10 kV and about 30 kV and the second electrical potential is between about 5 kV and about 18 kV.

2. The method of claim 1, where the distance between the orifice and the target first surface is between about 5 inches to about 8 inches.

3. The method of claim 2, where the distance between the orifice and the mask is between about 2 inches to about 4 inches.

4. The method of claim 1, further comprising moving the orifice relative to the target.

5. The method of claim 1, where the aperture comprises a shape selected from the group consisting of round, obround, polygonal, rectangular, square, freeform, or combinations thereof.

6. A method for preparing an endoluminal prosthesis comprising:

providing an endoluminal prosthesis and an electrospinning apparatus;

the endoluminal prosthesis defining an interior lumen with a proximal end, a distal end, a first surface and an opposing second surface;

the electrospinning apparatus comprising a mandrel, a mask including an aperture, a reservoir loaded with a solution, an orifice fluidly coupled to the reservoir, and an energy source electrically coupled to the orifice and the mandrel;

locating the mandrel at least partially within the endoluminal prosthesis lumen, locating the orifice at a distance from the endoluminal prosthesis first surface, and locating the mask intermediate the orifice and the endoluminal prosthesis first surface;

applying a first electrical potential with the energy source to the orifice and the mask, and grounding the mandrel;

applying a second electrical potential to the mask, where the second electrical potential is less than the first electrical potential;

electrospinning the solution through the mask aperture onto the endoluminal prosthesis first surface;

where the first electrical potential is between about 10 kV to about 30 kV and the second electrical potential is between about 5 kV to about 18 kV.

7. The method of claim 6, where the solution comprises at least one material selected from the group comprising polymers, proteins, and bioactive agents.

8. The method of claim 6, where the distance between the orifice and the endoluminal prosthesis first surface is between about 5 inches to about 8 inches.

9. The method of claim 8, where the distance between the orifice and the mask is between about 2 inches to about 4 inches.

10. The method of claim 6, further comprising moving the endoluminal prosthesis at least longitudinally relative to the orifice and further comprising electrospinning the solution about a longitudinal length of the endoluminal prosthesis.

11. The method of claim 6, further comprising moving the endoluminal prosthesis at least rotationally about an axis orthogonal to the orifice and further comprising electrospinning the solution about a circumferential length of the endoluminal prosthesis.

12. The method of claim 6, where the aperture comprises a shape selected from the group consisting of round, obround, polygonal, rectangular, square, freeform, or combinations thereof.

13. The method of claim 1, the mandrel comprising a material selected form the group consisting of metallic material and polymeric material.

14. The method of claim 1, the mandrel comprising a polytetrafluoroethy lene coating.

15. A method for preparing an endoluminal prosthesis comprising:

providing an endoluminal prosthesis and an electrospinning apparatus;

the endoluminal prosthesis defining an interior lumen with a proximal end, a distal end, a first surface and an opposing second surface;

the electrospinning apparatus comprising a mandrel, a mask including an aperture, a reservoir loaded with a solution, an orifice fluidly coupled to the reservoir, a ground plane, and an energy source electrically coupled to the orifice, the mandrel and the mask;

locating the mandrel at least partially within the endoluminal prosthesis lumen and adjacent the endoluminal prosthesis second surface, locating the orifice between about 5 inches to about 8 inches from the endoluminal prosthesis first surface, and locating the mask intermediate the orifice and the endoluminal prosthesis first surface and between about 2 inches to about 4 inches from the orifice;

applying a first electrical potential between about 10 kV to about 30 kV with the energy source to the orifice and a second electrical potential between about 5 kV to about 18 kV with the energy source to the mask;

grounding the mandrel and the ground plane;

moving the orifice relative to the endoluminal prosthesis;

electrospinning the solution through the mask aperture onto the endoluminal prosthesis first surface.

* * * * *